US010939710B2

(12) United States Patent
Oku et al.

(10) Patent No.: US 10,939,710 B2
(45) Date of Patent: Mar. 9, 2021

(54) PROTECTIVE CLOTHING FOR EXERCISE

(71) Applicants: Nouvelle Vague International Co., Ltd., Kanagawa (JP); Katsushige Yokoyama, Osaka (JP)

(72) Inventors: Yuji Oku, Kanagawa (JP); Katsushige Yokoyama, Osaka (JP)

(73) Assignees: Nouvelle Vague International Co., Ltd., Kanagawa (JP); Katsushige Yokoyama, Osaka (JP)

( * ) Notice: Subject to any disclaimer, the term of this patent is extended or adjusted under 35 U.S.C. 154(b) by 284 days.

(21) Appl. No.: 15/304,984

(22) PCT Filed: Jan. 14, 2015

(86) PCT No.: PCT/JP2015/050769
§ 371 (c)(1),
(2) Date: Oct. 18, 2016

(87) PCT Pub. No.: WO2015/162945
PCT Pub. Date: Oct. 29, 2015

(65) Prior Publication Data

US 2017/0202277 A1 Jul. 20, 2017

(30) Foreign Application Priority Data

Apr. 23, 2014 (JP) ..... JP2014-088853

(51) Int. Cl.
*A41D 13/012* (2006.01)
*A41H 43/04* (2006.01)
(Continued)

(52) U.S. Cl.
CPC ..... *A41D 13/012* (2013.01); *A41D 27/245* (2013.01); *A41H 43/04* (2013.01); *B63C 11/04* (2013.01); *B63C 2011/046* (2013.01)

(58) Field of Classification Search
CPC ..... A41D 13/012; A41D 27/245; A41D 13/0015; A41D 13/02; A41D 13/0125;
(Continued)

(56) References Cited

U.S. PATENT DOCUMENTS 3,305,423 A * 2/1967 Le Masson ..... A41D 27/245 156/182
3,369,263 A * 2/1968 Kreckl ..... A41D 13/0125 441/104
(Continued)

FOREIGN PATENT DOCUMENTS

JP 06-240504 A 8/1994
JP H07-21499 U 4/1995
(Continued)

*Primary Examiner* — Sally Haden
(74) *Attorney, Agent, or Firm* — Dilworth & Barrese, LLP

(57) ABSTRACT

[Problem] To provide a body protection product such as a wetsuit that does not require a troublesome and time-consuming step such as machine sewing, does not cause discomfort for the wearer, and does not result in a loss to the degree of freedom in terms of design. [Solution] A wetsuit (10), in which a highly stretchable and elastic sheet-shaped fabric is draped so as to match the concave and convex features of the body shape of a wearer and a plurality of fabric pieces (11) are prepared, an adhesive (3) is applied to the draping surfaces of the fabric pieces (11), and the draping surfaces are then pressed against each other and joined without stitching, whereby a three-dimensional clothing base (1) is formed. Next, an adhesive (4) is applied to the surface of the clothing base and stretching is performed, whereby the surface of the clothing base is covered by a stretchable covering material (2) formed to match the shape of the clothing base (1). The clothing base (1) and the covering material (2) are compressed under heating and thereby made to adhere to each other.

6 Claims, 8 Drawing Sheets

(51) Int. Cl.
*A41D 27/24* (2006.01)
*B63C 11/04* (2006.01)

(58) Field of Classification Search
CPC ..... A41D 31/0005; A41D 2300/52; A41D 2400/24; A41D 2400/32; A41D 2400/38; A41D 2600/10; A41H 43/04; B63C 11/04
See application file for complete search history.

(56) References Cited

U.S. PATENT DOCUMENTS

| | | | | | |
|---|---|---|---|---|---|
| 3,404,406 | A * | 10/1968 | Balliet | B63C 11/02 | 2/2.16 |
| 3,444,570 | A * | 5/1969 | Smith | B63C 9/093 | 441/104 |
| 6,514,590 | B1 * | 2/2003 | Shih | A41D 27/245 | 428/60 |
| 8,393,012 | B2 * | 3/2013 | Shiue | A41D 13/012 | 2/2.15 |
| 2007/0212957 | A1 * | 9/2007 | Halliday | A41D 13/00 | 441/80 |
| 2007/0294797 | A1 * | 12/2007 | Furgerson | A41D 13/012 | 2/2.15 |
| 2013/0042377 | A1 * | 2/2013 | Moore | A41D 13/012 | 2/2.16 |
| 2013/0192943 | A1 * | 8/2013 | Cross | B29C 66/7392 | 190/126 |

FOREIGN PATENT DOCUMENTS

| | | | |
|---|---|---|---|
| JP | 3071508 | U | 9/2000 |
| JP | 2006-516687 | A | 7/2006 |

* cited by examiner

PROTECTIVE CLOTHING FOR EXERCISE

TECHNICAL FIELD

The present invention relates to body protection products such as wetsuits which are worn for water sports and other various operations in or on the water and used to protect the bodies of the wearers from body temperature loss, traumatic injury, harmful organisms, and the like. More specifically, the present invention relates to a structure for a body protection product which offers such an improved wearing comfort that the wearer does not feel uncomfortable inputting on the body protection product or during an exercise or an operation and the body protection product does not inhibit any action of the wearer.

BACKGROUND ART

For example, wetsuits and drysuits are known as body protection products worn for water sports and other various operations in or on the water. A wetsuit achieves the heat retaining property by retaining water such as seawater entering the inside of the suit as long as possible. On the other hand, a drysuit achieves the heat retaining property with a sealed structure which does not allow entry of water through portions near the wrists, the neck, and the like to keep the inside in a dry state.

In addition, examples of other body protection products include gloves that protect the hands of the wearer, boots that protect the feet of the wearer, a hood that protects the head of the wearer, and the like.

Such a body protection product is manufactured, for example, as follows. Specifically, a sheet-shaped fabric is used in which a stretchable covering member such as a knitted fabric is attached to one surface side or both surface sides of a soft elastic member such as chloroprene rubber serving as a core member. The sheet-shaped fabric is cut to form multiple fabric pieces (parts) fitting the body parts of a wearer. These fabric pieces are assembled and then joined and integrated together by machine-sewing or the like. In this manner, the body protection product is formed to fit the body shape of the wearer.

However, the sewing of fabric pieces together as described above requires burdensome and intense labor, and is time-consuming. In addition, this leads to the increase in cost of the product.

In addition, since the fabric and the thread used for the sewing stretch differently, the thread for the sewing may inhibits the stretching of the fabric in putting on the body protection product or during an operation, so that the wearer may feel uncomfortable. Moreover, as shown by the arrows in FIG. 10, when a fabric 101 is stretched, large loads are imposed on sewed portions 131, so that portions near a joint portion of the fabric 101 may be broken by the thread for the sewing. Moreover, the thread with which the fabric pieces are joined is raised and exposed on the surface of the body protection product. As a result, the appearance of the body protection product is deteriorated, and the degree of freedom of design of the body protection product is limited.

In this respect, as a method for manufacturing a wetsuit by which cut surfaces can be surely joined to each other without requiring a machine-sewing step or the like, a technique has been proposed in which an adhesive agent is applied onto cut surfaces of fabric pieces, then the fabric pieces are brought into contact with each other and adhered to each other, and then a predetermined reinforcing tape having a predetermined width is attached to a surface of the adhered portion to reinforce the joint portion (see Patent Document 1).

In a wetsuit manufactured by the technique described in Patent Document 1, no thread for sewing fabric pieces together is present. However, the fabric stretches differently in the region to which the reinforcing tape is attached and the region to which no reinforcing tape is attached. As a result, when the wearer moves, a large load acts on the boundary portion between these regions, so that the wearer may feel uncomfortable. In addition, the bulky reinforcing tape is exposed on the surface of the body protection product. This also deteriorates the appearance, and imposes a limitation on the degree of freedom of design of the body protection product.

CITATION LIST

Patent Literature

Patent Document 1: Japanese Utility Model Registration No. 3071508

SUMMARY OF INVENTION

Technical Problem

The present invention has been made in view of the above-described circumstances, and an object of the present invention is to provide a body protection product such as a wetsuit which does not require a burdensome time-consuming step such as a machine-sewing step, which does not make the wearer uncomfortable, and which does not lose the degree of freedom of design.

Solution to Problem

To achieve the above-described object, a first body protection product of the present invention comprises: a clothing base member three-dimensionally formed by joining a plurality of fabric pieces, which have been prepared by cutting using a draping technique, together not by sewing but by using an adhesive agent; and a covering member which entirely covers at least one surface side of the clothing base member and which is stretchable, wherein the clothing base member and the covering member are attached to each other by using an adhesive agent.

A second body protection product of the present invention, which is a preferred embodiment, is the first body protection product, wherein the clothing base member is formed by using fabric pieces made of a foam rubber material containing cells therein.

A third body protection product of the present invention, which is another preferred embodiment, is the first or second body protection product, wherein the clothing base member is formed by assembling fabric pieces having cut surfaces cut in the form of saw teeth-shaped mountains.

A fourth body protection product of the present invention, which is another preferred embodiment, is any one of the first to third body protection products further comprising another covering member which entirely covers the other surface side of the clothing base member and which is stretchable.

A fifth body protection product of the present invention, which is another preferred embodiment, is the fourth body protection product, wherein the covering members on the one surface side and on the other surface side of the clothing base member are different in color or pattern.

A sixth body protection product of the present invention, which is another preferred embodiment, is any one of the first to fifth body protection products, wherein the covering member is formed seamlessly and integrally.

Meanwhile, a method for manufacturing each of the body protection products of the present invention comprises: preparing a plurality of fabric pieces fitting a contour of a body shape of a wearer by cutting a sheet-shaped fabric excellent in stretchability and elasticity using a draping technique; applying an adhesive agent onto cut surfaces of the fabric pieces; then assembling the fabric pieces together with the cut surfaces being in contact with one another; joining the fabric pieces together not by sewing but by compression bonding to form an integrated three-dimensional clothing base member; then entirely covering a surface of the clothing base member, which serves as a core member, with a covering member made of a stretchable woven or knitted fabric formed to take a shape fitting the clothing base member when stretched; and attaching the clothing base member and the covering member to each other by using an adhesive agent.

Specifically, in the method for manufacturing a body protection product, the adhesive agent is a cross linkable adhesive agent that joins adherends to each other by cross-linking, and the clothing base member and the covering member are attached to each other by applying the adhesive agent onto the surface of the three-dimensionally formed clothing base member, then, before the adhesive agent has been dried, covering the clothing base member with the covering member, and cross-linking the adhesive agent at room temperature.

In addition, in the present invention, the method for manufacturing a body protection product is preferably such that the adhesive agent is a cross linkable adhesive agent that joins adherends to each other by cross-linking, and the clothing base member and the covering member are attached to each other by applying the adhesive agent onto the surface of the three-dimensionally formed clothing base member, reducing stickiness of the adhesive agent by drying the adhesive agent, then covering the clothing base member with the covering member, and further applying a pressure, while the cross-linking of the adhesive agent is being accelerated by heating.

Moreover, in the present invention, the method for manufacturing a body protection product is preferably such that the adhesive agent is a cross linkable adhesive agent that joins adherends to each other by cross-linking, and the clothing base member and the covering member are attached to each other by applying the adhesive agent onto one surface side of the covering member, reducing stickiness of the adhesive agent by drying the adhesive agent, then covering the three-dimensionally formed clothing base member with the covering member with the applied adhesive agent located on an inner surface side, and further applying a pressure, while the cross-linking of the adhesive agent is being accelerated by heating.

Further, in the present invention, the method for manufacturing a body protection product is preferably such that the adhesive agent is a cross linkable adhesive agent that joins adherends to each other by cross-linking, and the clothing base member and the covering member are attached to each other by covering, with the covering member, the three-dimensional clothing base member formed by using the sheet-shaped fabric on one surface side of which the adhesive agent has been applied, and further applying a pressure, while the cross-linking of the adhesive agent is being accelerated by heating.

Furthermore, a preferred body protection product of the present invention is any one of the methods for manufacturing a body protection product, wherein the adhesive agent is a film-shaped cross linkable adhesive agent that joins adherends to each other by cross-linking, and the clothing base member and the covering member are attached to each other by covering the three-dimensionally formed clothing base member with the covering member, then placing the adhesive agent between the clothing base member and the covering member, and further applying a pressure, while the cross-linking of the adhesive agent is being accelerated by heating.

Advantageous Effects of Invention

In the body protection product of the present invention, the multiple fabric pieces, which have been prepared by cutting using a draping technique, are not sewn together, but joined together by using an adhesive agent to form the three-dimensional clothing base member. Further, the surface of the clothing base member is entirely covered with the stretchable covering member, and the clothing base member and the covering member are attached to each other by using the adhesive agent. Hence, when the fabric pieces constituting the clothing base member are stretched in response to an action of the wearer of the body protection product, the covering member is also stretched following the stretching of the fabric pieces, because the clothing base member and the covering member are attached to each other. Accordingly, the load caused by the stretching of the fabric pieces is dispersed all over the fabric pieces through the covering member. Hence, the load does not concentrated on the joint portions between the fabric pieces, and the fabric is stretched uniformly.

Therefore, it is possible to provide a body protection product such as a wetsuit which does not require a burdensome and time-consuming step such as a machine-sewing step and which has such an improved wearing comfort that the body protection product does not inhibit an action of the wearer and does not make the wearer uncomfortable during an exercise or an operation. In addition, since the joint portions between the fabric pieces are covered with the covering member and are not exposed on the surface of the body protection product, the degree of freedom of design is not lost. Hence, it is possible to provide a body protection product such as a wetsuit to which a desired design can be applied.

DESCRIPTION OF EMBODIMENTS

Hereinafter, examples of embodiments of the present invention are described with reference to the drawings. Note that the embodiments described below are preferred specific examples of the present invention, and hence have various technical limitations; however, the scope of the present invention is not limited to these embodiments, unless otherwise noted in the description below.

First, examples of body protection products according to the present invention include protective suits, so called wetsuits and drysuits, worn for various water sports in or on the water such as diving, snorkeling, surfing, sailboarding, bodyboarding, water skiing, jet skiing, yachting, and fishing, lifesaving, camera shooting, harvesting of seaweed, shellfish, or the like, and other various operations in or on the water, as well as gloves, boots, hoods, and the like worn for the above-described purposes to partially protect the hands, feet, head, and the like.

In addition, the protective suits include ONE-PIECE suits (also referred to as full suits) which are of a long-sleeve and long-leg type and in which the upper wear and the lower wear are integrated, SEAGULL suits which are of a short-sleeve and long-leg type and in which the upper wear and the lower wear are integrated, LONG JOHN suits which are of a sleeveless and long-leg type and in which the upper wear and the lower wear are integrated, spring suits which are of a short-sleeve or long-sleeve and short-leg type and in which the upper wear and the lower wear are integrated, jackets (also referred to as TAPPER) which are of a short-sleeve or long-sleeve type and which include only the upper wear, BOLEROS (sleeveless vests) which are of a sleeveless type and which include only the upper wear, and pants which are of a short-leg or long-leg type and which include only the lower wear.

In this embodiment, a full suit-type wetsuit is described as an example of the body protection product.

Figure 1A:
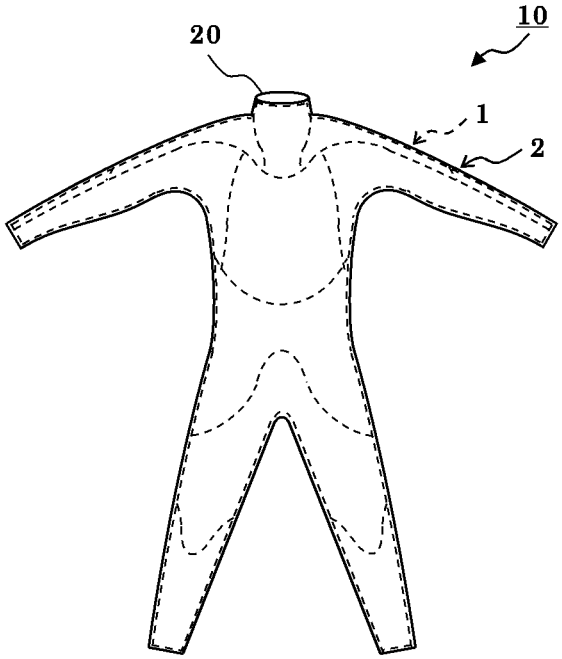
FIG. 1 shows views showing a wetsuit taken as an example of a body protection product according to the present invention, where Part (A) is a front view, and Part (B) is a back view.
Figure 1B:
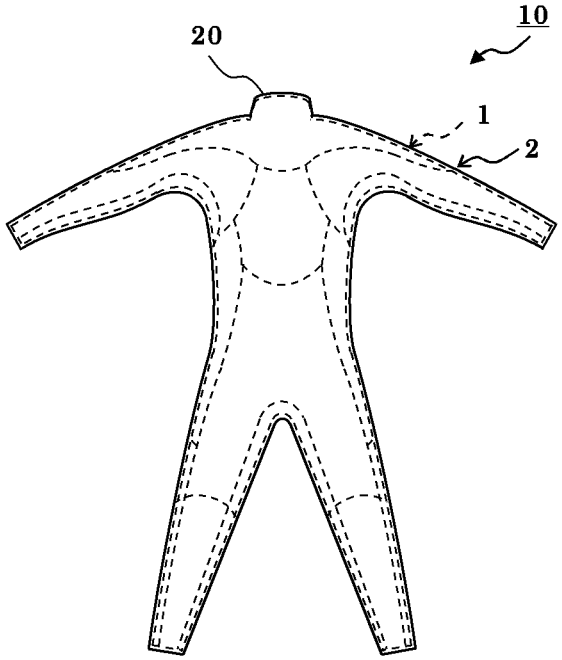

FIG. 1 shows views showing a wetsuit as a protective clothing for exercise according to the present invention, where FIG. 1A is a front view, and FIG. 1B is a back view.

As shown in FIG. 1, a wetsuit 10 of this embodiment includes: a clothing base member 1 which covers the arms, the legs, and the torso of a wearer; and a covering member 2 which covers at least one surface side of the clothing base member 1. Specifically, the clothing base member 1 is a soft and elastic member serving as a core member, and the covering member 2 is attached onto any one of or each of an outer surface and an inner surface of the clothing base member 1.

FIG. 1 shows the wetsuit 10 in a state where the covering member 2 formed to be of the full suit type covers the entire outer surface of the clothing base member 1 which is formed to be of the full suit type so as to cover the arms, the legs, and the torso as one piece.

Figure 2A:
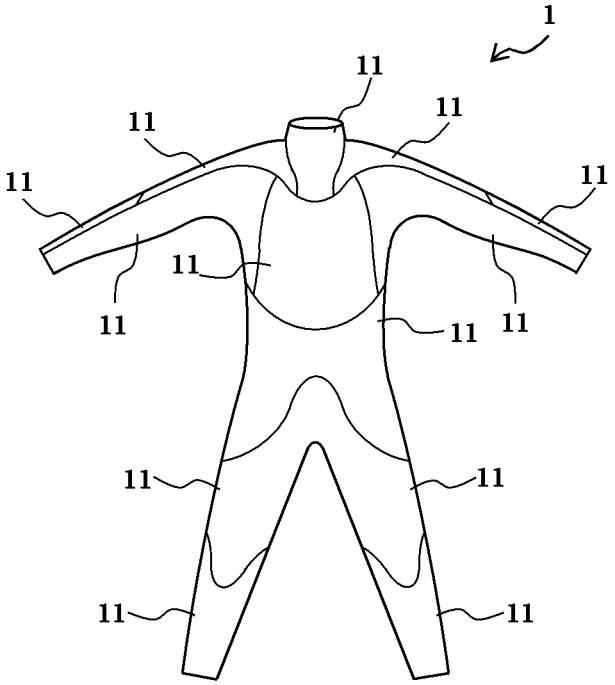
FIG. 2 shows views showing a clothing base member constituting the wetsuit taken as the body protection product according to the present invention, where Part (A) is a front view, and Part (B) is a back view.
Figure 2B:
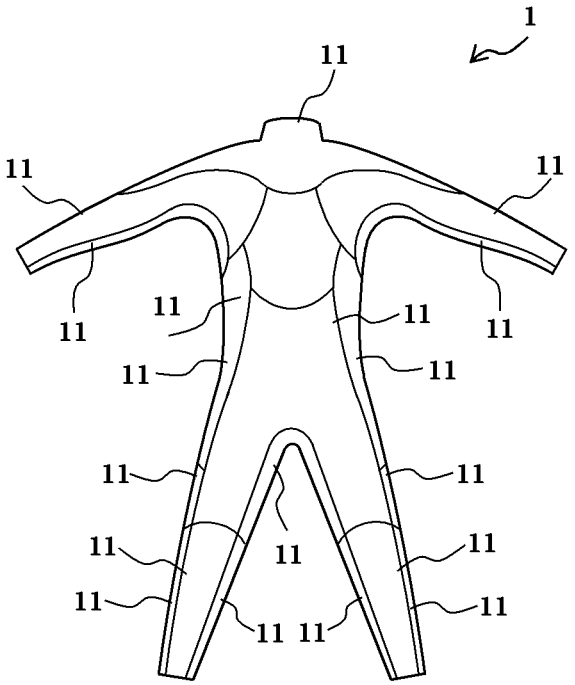

As shown in FIG. 2, the clothing base member 1 is three-dimensionally formed by assembling multiple fabric pieces 11, . . . , 11 together prepared by cutting using a draping technique to fit the contour of the body shape of a wearer.

FIG. 2 shows a state where the clothing base member 1 is constituted of the fabric pieces 11, . . . , 11, which constitute upper wear portions, lower wear portions, arm portions, and leg portions. In addition, the clothing base member 1 shown in FIG. 2 is formed by assembling the fabric pieces 11 together which have linearly cut surfaces.

The fabric pieces 11 are made of a sheet-shaped fabric made of a stretchable, water-resistant, soft, and elastic material. Examples of such a material include chloroprene rubber, isoprene rubber, butyl rubber, styrene-butadiene rubber, butadiene rubber, nitrile rubber, ethylene propylene rubber, chlorosulfonated polyethylene rubber, and other soft elastic materials. The thickness of the sheet-shaped fabric is preferably 3.5 to 5.0 mm, in general. However, the thickness is not limited to this range, but can be selected or designed, as appropriate, according to the application.

In addition, the clothing base member 1 may be formed by using fabric pieces 11 obtained by cutting a stretchable, soft, and elastic sheet made of a foam rubber material containing cells therein. The use of such a foam rubber material makes it possible to obtain a protective clothing for exercise excellent in heat retaining property and flexibility.

As shown in FIG. 3, this clothing main body 1 is formed not by sewing the fabric pieces 11, 11 together but by joining the fabric pieces 11, 11 together by using an adhesive agent 3.

Figure 3A:
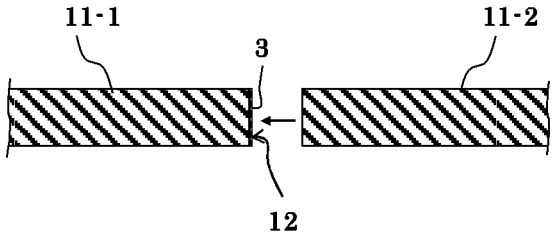
FIG. 3 illustrates a method for joining fabric pieces, which have been prepared by cutting using a draping technique, to each other in the body protection product according to the present invention, where Part (A) is an enlarged partial cross-sectional view showing a state where an adhesive agent is applied onto a cut surface of a fabric piece, Part (B) is an enlarged partial cross-sectional view showing a state where fabric pieces are brought into contact with each other and joined to each other, and Part (C) is an enlarged partial plan view showing a state where the fabric pieces are brought into contact with each other and joined to each other.
Figure 3B:
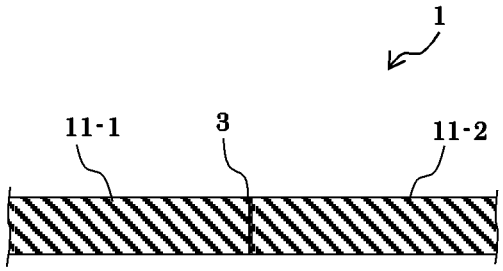
Figure 3C:
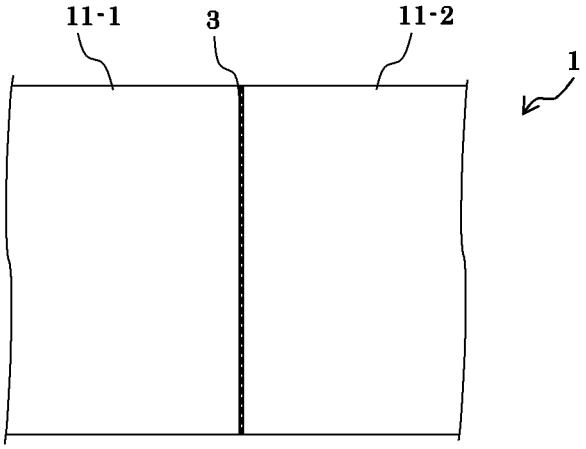

FIG. 3A shows a state where the adhesive agent 3 is applied onto the cut surface 12 of a first fabric piece 11-1, but the cut surface 12 of a second fabric piece 11-2 is yet to be brought into contact with the cut surface 12 of the first fabric piece 11-1 on which the adhesive agent 3 has been applied. In addition, FIGS. 3B and 3C show a state where the first fabric piece 11-1 and the second fabric piece 11-2 are joined to each other with the adhesive agent 3 by bringing the cut surface 12 of the second fabric piece 11-2 into contact with the cut surface 12 of the first fabric piece 11-1, and the clothing base member 1 is thus formed. After the cut surfaces of the first fabric piece 11-1 and the second fabric piece 11-2 are brought into contact with each other, it is preferable to compression-bond the first fabric piece 11-1 and the second fabric piece 11-2 to each other by applying a pressure.

Alternatively, as shown in FIG. 9, the clothing base member 1 may be formed by assembling fabric pieces cut to have cut surfaces 12 in the form of saw teeth-shaped mountains.

Figure 9A:
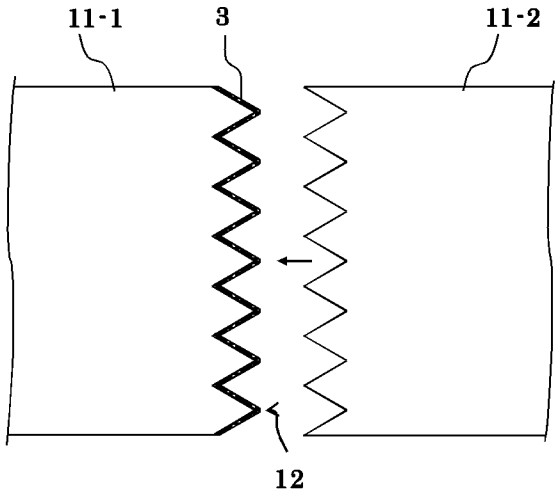
FIG. 9 illustrates a method for joining fabric pieces to each other, which have been prepared by cutting using a draping technique to have saw teeth-shaped cut surfaces, where Part (A) is an enlarged partial plan view showing a state where an adhesive agent is applied onto a cut surface of one of the fabric pieces, and Part (B) is an enlarged partial plan view showing a state where the fabric pieces are brought into contact with each other and joined to each other.
Figure 9B:
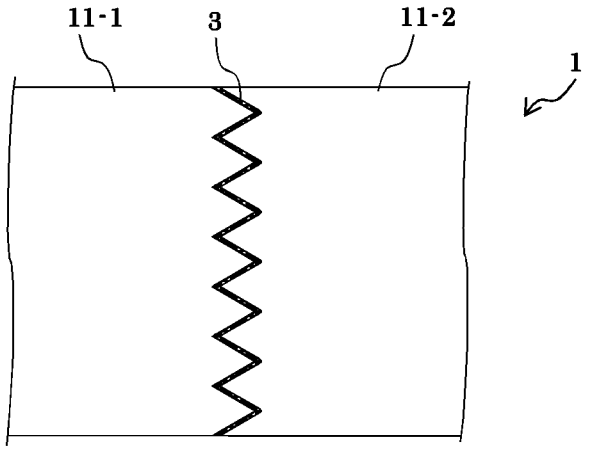
Figure 10:
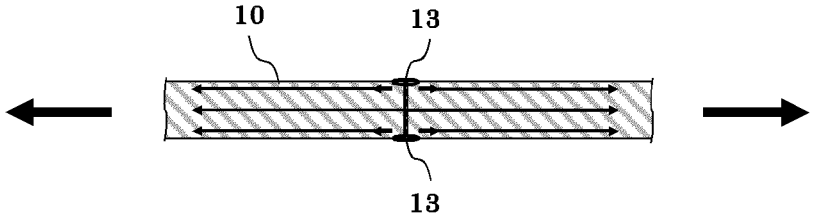
FIG. 10 is an enlarged partial schematic cross-sectional view illustrating stretching of a conventional body protection product.

FIG. 9A shows a state where an adhesive agent 3 is applied onto the cut surface 12 of a first fabric piece 11-1, and the cut surface 12 of a second fabric piece 11-2 is about to be brought into contact with the cut surface 12 of the first fabric piece 11-1 on which the adhesive agent 3 has been applied. In addition, FIG. 9B shows a state where the clothing base member 1 is formed by joining the first fabric piece 11-1 and the second fabric piece 11-2 to each other. In addition, after the cut surfaces of the first fabric piece 11-1 and the second fabric piece 11-2 are brought into contact with each other, it is preferable to compression bond the first fabric piece 11-1 and the second fabric piece 11-2 to each other by applying a pressure.

When the fabric pieces 11 are cut into the form of the saw teeth-shaped mountains as described above, the cut surfaces of the fabric pieces 11, 11 can be easily brought into contact with each other, without any misalignment.

Figure 4A:
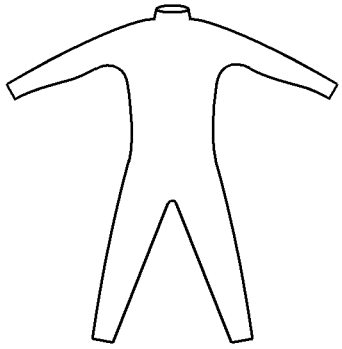
FIG. 4 shows views showing a covering member constituting the wetsuit taken as the example of the body protection product according to the present invention, where Part (A) is a front view showing a state before the covering member is stretched, and Part (B) is a front view showing a state where a neck insertion hole is extended.

On the other hand, the covering member 2 is contracted to be smaller than the clothing base member 1 in a normal state, as shown in FIG. 4A. The covering member 2 is a stretchable woven or knitted fabric formed to take the same shape as the clothing base member 1 (i.e., to fit the shape of the clothing base member 1) when stretched.

Figure 4B:
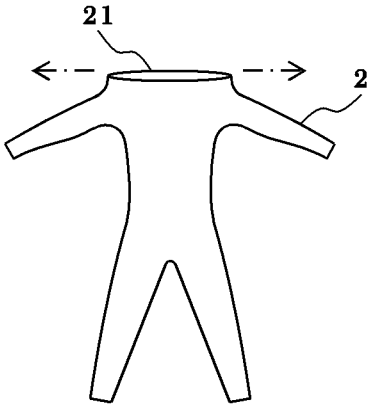
Figure 5:
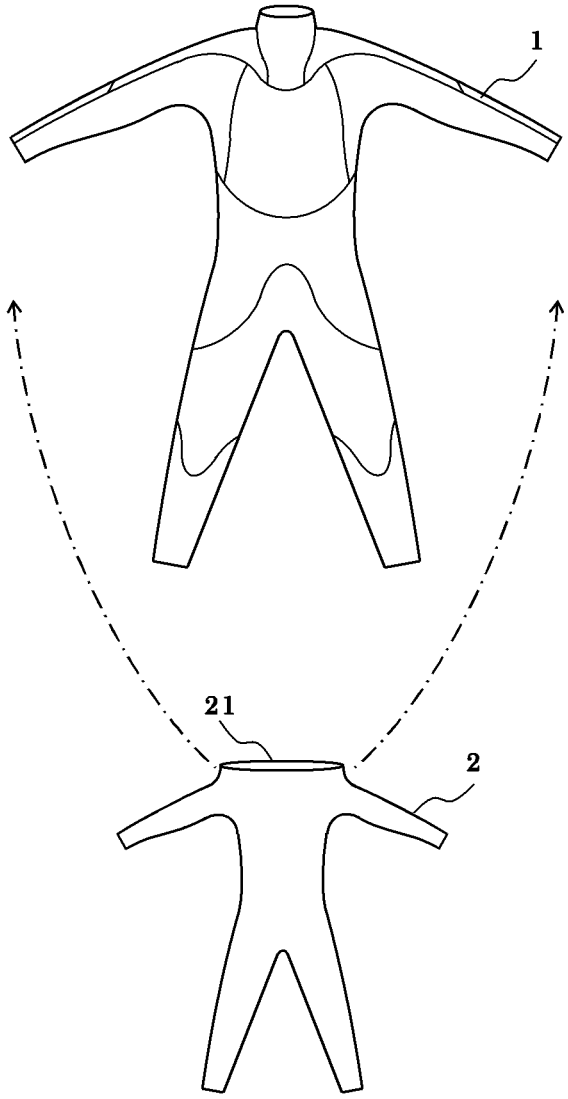
FIG. 5 is a schematic view illustrating a method for covering a clothing base member with a covering member by extending the neck insertion hole of the covering member, the clothing base member constituting the wetsuit taken as the example of the body protection product according to the present invention.

In addition, as shown in FIG. 4B, the covering member 2 includes a neck insertion hole 21 which extends to an extent that the clothing base member 1 can be accommodated (inserted), and is configured to facilitate the covering of the clothing base member 1 with the covering member 2 through the neck insertion hole 21, as shown in FIG. 5.

FIG. 4A shows a state where the covering member 2 is contracted to be smaller than the clothing base member 1, while FIG. 4B shows, by the dashed-dotted lines, that the neck insertion hole 21 of the covering member 2 can be extended to an extent that the clothing base member 1 can be inserted.

In addition, FIG. 5 shows, by the dashed-dotted lines, that the clothing base member 1 is covered with the covering member 2 by extending the neck insertion hole 21 of the covering member 2, and accommodating the clothing base member 1 in the covering member 2 through the neck insertion hole 21.

The covering member 2 may be, for example, a knitted fabric capable of expanding and contracting in longitudinal and transverse directions. Specific examples the knitted fabric include nylon jersey fabrics, polyester jersey fabrics, and the like. Especially, a nylon jersey fabric is the most preferable for wetsuit applications, considering the stretchability and flexibility.

Suppose a case where the covering member 2 is a nylon jersey fabric. In such a case, if the thickness of the fiber is 40 denier or less, the strength of the fabric is so low that the fabric is easily broken. On the other hand, if the thickness is 70 denier or more, the texture of the fabric is so coarse that the surface becomes granulated, and the fabric may cause discomfort because of rubbing on the skin, when worn. Hence, when the covering member 2 is a nylon jersey fabric, the nylon jersey fabric is preferably knitted by using a fiber having a thickness of 40 to 70 denier, and a covering member 2 knitted by using a fiber having a thickness of 50 denier is preferable.

In addition, the covering member 2 may have seams at the boundaries among arm-covering portions, torso covering portions, and leg covering portions, but is preferably formed seamlessly and integrally. When the covering member 2 is formed seamlessly and integrally, the covering member 2 does not cause any discomfort due to such seams, when worn. Such a covering member 2 formed seamlessly and integrally can be manufactured with a so-called seamless knitting machine.

Note that the covering member 2 may be formed of a blended yarn obtained by twisting multiple yarns together. Also in this case, the thickness of the blended yarn as a whole is preferably 40 to 70 denier considering the wearing comfort, the strength, and the like.

Moreover, the covering member 2 may be one colored as appropriate or a pile fabric capable of expanding and contracting in longitudinal and transverse directions with a high stretchability.

The covering member 2 reinforces the clothing base member 1, because the clothing base member 1 and the covering member 2 are attached to each other by using an adhesive agent 4, as shown in FIGS. 6 and 7.

In addition, the covering member 2 only needs to cover at least one surface side of the clothing base member 1. Accordingly, the covering member 2 may be attached to only one of the one surface side and the other surface side of the clothing base member 1, or covering members 2 may be attached to both of the one surface side and the other surface side of the clothing base member 1. When the covering members 2 are attached to both of the one surface side and the other surface side of the clothing base member 1, joint portions between the fabric pieces 11 can be further reinforced so as not to be easily broken by the stretching of the clothing base member 1. In addition, in the clothing base member 1, the joint portions between the fabric pieces 11 on both the top and bottom surfaces are covered with the covering members 2, and are not exposed to the outside at all. Hence, it is possible to obtain a reversible wetsuit 10 with good appearance which can be used with either outside.

In addition, when the covering members 2 are attached to both of the one surface side and the other surface side of the clothing base member 1, the covering member 2 on one surface side of the clothing base member 1 may have a different color or pattern from that of the covering member 2 on the other surface side. As a result, the wetsuit 10 has different designs on the one surface side and the other surface side, and is further decorated.

Figure 6A:
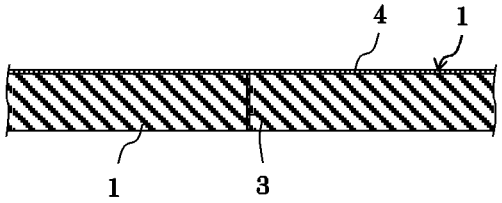
FIG. 6 illustrates a method for attaching a covering member to one surface side of the clothing base member constituting the wetsuit taken as the example of the body protection product according to the present invention, where Part (A) is an enlarged partial cross-sectional view showing a state where an adhesive agent is applied onto one surface side of the clothing base member, Part (B) is an enlarged partial cross-sectional view showing a state where the covering member is put on, and Part (C) is an enlarged partial cross-sectional view showing a state where thermocompression-bonding is performed.
Figure 6B:
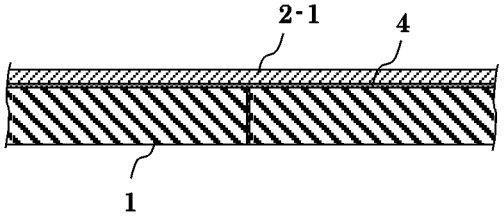
Figure 6C:
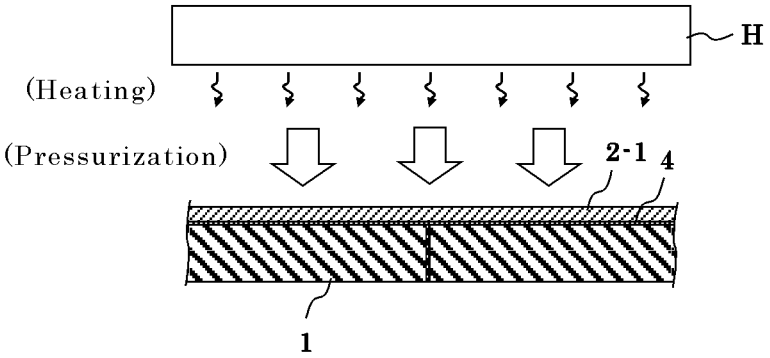

FIG. 6A shows a state where the adhesive agent 4 is applied onto one surface 13 side of the clothing base member 1 in which the first fabric piece 11-1 and the second fabric piece 11-2 have been joined to each other. FIG. 6B shows a state where the clothing base member 1 and the first covering member 2-1 are attached to each other with the adhesive agent 4, with the one surface 13 side of the clothing base member 1 being entirely covered with the first covering member 2-1. In addition, FIG. 6C shows a state where the first covering member 2-1 is attached onto the one surface 13 side of the clothing base member 1 by heating the first covering member 2-1 with a heater H from the above, and further compression bonding the first covering member 2-1 by applying a pressure.

Figure 7A:
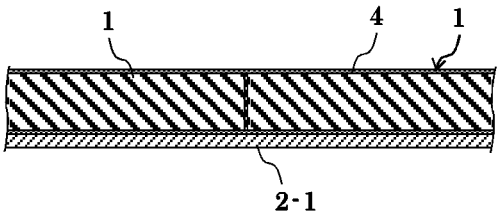
FIG. 7 illustrates a method for attaching a covering member onto the other surface side of the clothing base member constituting the wetsuit taken as the example of the body protection product according to the present invention, where Part (A) is an enlarged partial cross-sectional view showing a state where an adhesive agent is applied onto the other surface side of the clothing base member, Part (B) is an enlarged partial cross-sectional view showing a state where an covering member is put on, and Part (C) is an enlarged partial cross-sectional view showing a state where thermocompression-bonding is performed.
Figure 7B:
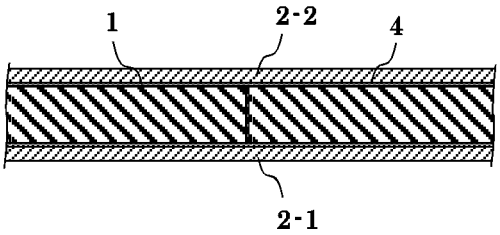
Figure 7C:
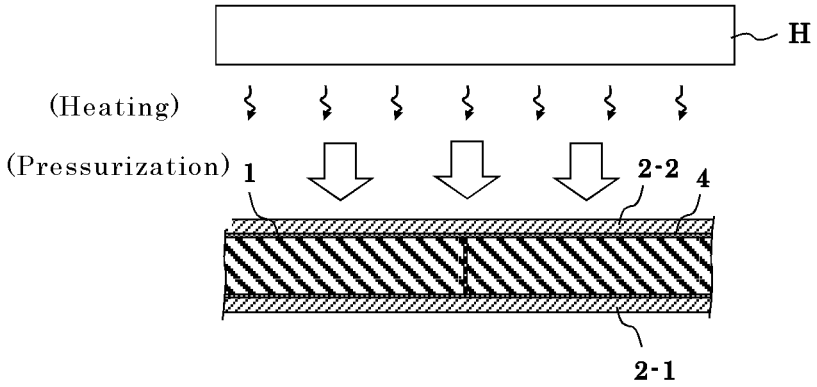

In addition, FIG. 7A shows a state where the adhesive agent 4 is applied onto the other surface 14 side of the clothing base member 1 in which the first covering member 2-1 has been attached onto the one surface 13 side. FIG. 7B shows a state where the clothing base member 1 and the second covering member 2-2 are attached to each other with the adhesive agent 4, with the other surface 14 side of the clothing base member 1 being entirely covered with the second covering member 2-2. Moreover, FIG. 7C shows a state where the second covering member 2-2 is attached onto the other surface 14 side of the clothing base member 1 by heating the second covering member 2-2 with a heater H from the above, and further compression bonding the second covering member 2-2 by applying a pressure.

Here, the adhesive agent 3 used to join the multiple fabric pieces 11, . . . , 11, which have been prepared by cutting using a draping technique, together may be the same as or different from the adhesive agent 4 used to attach the clothing base member 1 and the covering member 2 to each other. Here, the adhesive agent 3 used to join the fabric pieces 11 together joins pieces of the same material together, whereas the adhesive agent 4 used to attach the clothing base member 1 and the covering member 2 to each other attaches different materials to each other. For this reason, an adhesive agent optimal for each case can be selected, as appropriate.

Specifically, the adhesive agent 3 used to join the fabric pieces 11 together may be, for example, a solvent-type adhesive agent containing chloroprene as a main component and using an organic solvent such as toluene, ethyl acetate, or methyl ethyl ketone.

On the other hand, the adhesive agent 4 used to attach the clothing base member 1 and the covering member 2 to each other may be a cross linkable adhesive agent which is cross-linked to join adherends to each other, such as a reaction curing-type vulcanizable adhesive agent containing a main agent mainly containing chloroprene rubber and a curing agent mainly containing a polyisocyanate compound.

In addition, the adhesive agent 4 used to attach the clothing base member 1 and the covering member 2 to each other may be a film-shaped vulcanizable adhesive agent. When heated, the film-shaped vulcanizable adhesive agent melts and then is vulcanized to achieve the bonding. The film-shaped vulcanizable adhesive agent is disposed between an adherend and another adherend, and these adherends are thermocompression bonded to each other. Such a film-shaped vulcanizable adhesive agent is environmentally friendly because it is solvent-free, and can shorten the operation time because the bonding can be achieved just by heating. In addition, since the vulcanizable adhesive agent is film-shaped, the thickness is uniform, and nonuniformity in attachment due to uneven application does not occur.

Note that, as described above, it is also possible to use, as the adhesive agent 3 used to join the fabric pieces 11 together, the same adhesive agent as that used to attach the clothing base member 1 and the covering member 2 to each other, i.e., the reaction curing-type vulcanizable adhesive agent containing a main agent mainly containing chloroprene latex or the like and a curing agent mainly containing a polyisocyanate compound. The use of the same adhesive agent facilitates the management and makes it possible to prevent misuse.

Note that the wetsuit 10 according to this embodiment shown in FIG. 1 is not provided with any fastener which enables an area to be opened, as appropriate, for a wearer to put on and take off the wetsuit 10, such as a zip fastener referred to as a waterproof fastener or a water-tight fastener. However, the body protection product according to the present invention is not limited thereto.

Accordingly, after the wetsuit 10 as shown in FIG. 1 is manufactured, if necessary, an opening portion (nick) for a wearer to put on or take off the wetsuit 10 may be provided at a suitable position, and a fastener such as a zip fastener or a hook-and-loop fastener may be provided to the opening portion. This allows the wearer to easily put on and take off the wetsuit by opening and closing the fastener provided at the opening portion.

Next, methods for manufacturing a body protection product according to the present invention are described. Body protection products according to the present invention, which are not limited to the wetsuit 10 according to this embodiment but include other body protection products, can be manufactured by several methods described below. Here, five manufacturing methods are described as examples. The methods can be designed and modified, as appropriate, according to requirements such as the time, labor, and cost required for the manufacturing.

First Manufacturing Method

First, a sheet-shaped fabric made of a foam rubber material containing many small cells therein and being excellent in stretchability and elasticity is used. The sheet-shaped fabric is cut using a draping technique to prepare multiple fabric pieces 11, . . . , 11 fitting a contour of a body shape of a wearer.

Subsequently, an adhesive agent 3 is applied onto cut surfaces 12 of the fabric pieces 11.

The adhesive agent 3 may be, for example, a reaction curing-type vulcanizable adhesive agent. Specifically, a main agent manufactured by No-tape INDUSTRIAL CO., LTD. with the product number of "6870" can be used as the main agent mainly containing chloroprene rubber, whereas as a curing agent manufactured by No-tape INDUSTRIAL CO., LTD. with the product number "U-5" can be used as the curing agent mainly containing a polyisocyanate compound. The main agent and the curing agent are used after being mixed at a weight ratio of 100:1 to 100:3. Moreover, it is also possible to use a vulcanization accelerator manufactured by No-tape INDUSTRIAL CO., LTD. with the product number of "A-2". In this embodiment, a mixture of the main agent, the curing agent, and the vulcanization accelerator at a weight ratio of 100:3:3 is used as the adhesive agent 3.

Subsequently, the applied adhesive agent 3 is dried to an extent that the flowability of the adhesive agent 3 is lost. Then, the fabric pieces 11 are assembled together so that the cut surfaces 12 of the fabric pieces 11 can be in contact with one another. These fabric pieces 11, 11 are joined to one another not by sewing but by compression bonding. In this manner, an integrated and three-dimensional clothing base member 1 is formed. Here, the adhesive agent 3 is dried for the following reason. Specifically, when the adhesive agent 3 is flowable, the adhesive force is low, and the joined fabric pieces 11, 11 are easily separated. In contrast, when the adhesive agent 3 is dried moderately, the initial adhesive force is increased, and the compression bonding becomes easy to perform.

In addition, an adhesive agent 4 is applied onto a surface (one surface side) 13 of the three-dimensionally formed clothing base member 1. The adhesive agent 4 can be applied by, for example, spraying the adhesive agent 4 with a spray gun. The adhesive agent 4 may be, for example, the same reaction curing-type vulcanizable adhesive agent as the adhesive agent 3.

Moreover, a nylon jersey fabric made of a stretchable woven or knitted fabric which is formed seamlessly and integrally and which takes a shape fitting the clothing base member 1 when stretched is used as the covering member 2. Before the adhesive agent 4 is dried, the nylon jersey fabric 2 is placed to cover the clothing base member 1.

Then, the clothing base member 1 covered with the covering member 2 is allowed to stand at room temperature to cross-link the adhesive agent 4. Thus, a body protection product 10 can be manufactured in which the clothing base member 1 and the covering member 2 are attached to each other by using the adhesive agent 4. Note that the room temperature here refers to a state where neither heating nor cooling is performed from the outside system.

Second Manufacturing Method

Moreover, the body protection product of the present invention can also be manufactured by each of the following methods different from the first manufacturing method. In the manufacturing methods according to other embodiments described below, different points from those in the above-described first manufacturing method are mainly described. Accordingly, steps which are the same as those in the first manufacturing method are not described. In other words, steps are the same as those in the first manufacturing method, unless otherwise noted.

First, the steps of forming a three-dimensional clothing base member 1 by using a sheet-shaped fabric excellent in stretchability and elasticity and applying an adhesive agent 4 onto a surface (one surface side) 13 of the clothing base member 1 are the same as those in the first manufacturing method.

Subsequently, the stickiness of the adhesive agent 4 is reduced by drying the adhesive agent 4. Then, by using the clothing base member 1 as a core member, a covering member 2 made of a stretchable woven or knitted fabric formed to have a shape fitting the clothing base member 1 when stretched is placed to entirely cover the surface 13 of the clothing base member 1, on which the adhesive agent 4 has been applied. Here, the adhesive agent 4 is dried to efficiently perform the operation of placing the covering member 2 to cover the clothing base member 1, without any trouble due to the stickiness of the adhesive agent 4. Hence, the adhesive agent 4 is dried only to an extent that no problem is caused in the operation of placing the covering member 2.

Then, a pressure is applied to the clothing base member 1 covered with the covering member 2, while the cross-linking of the adhesive agent 4 is accelerated by heating. Thus, a body protection product 10 can be manufactured in which the clothing base member 1 and the covering member 2 are attached to each other by using the adhesive agent 4. Here, the pressure is applied to prevent the deformation of cells contained in the foam rubber material constituting the clothing base member 1 due to expansion by the heating.

Accordingly, it is not necessary to apply the pressure, when the clothing base member 1 and the covering member 2 are attached to each other by being allowed to stand at room temperature for a long period as in the case of the first manufacturing method. However, when the cross-linking of the adhesive agent 4 is accelerated by heating considering the production efficiency, it is preferable to apply the pressure to prevent the deformation of the clothing base member 1.

Note that the temperature at which the clothing base member 1 and the covering member 2 are heated for the attachment is at or below the melting points of the materials used. For example, when the covering member 2 is a nylon jersey fabric using a nylon fiber of 50 denier, the compression bonding is preferably performed by applying the pressure at 120° C. for about 1 minute.

Third Manufacturing Method

First, steps of forming a three-dimensional clothing base member 1 by using a sheet-shaped fabric excellent in stretchability and elasticity are the same as those in the first manufacturing method.

Subsequently, an adhesive agent 4 is applied onto a surface (one surface side) 13 of the covering member 2. Here, how to apply the adhesive agent 4 onto the covering member 2 is not particularly limited. Accordingly, for example, it is possible to employ a method in which the covering member 2 is put on a human-shaped doll such as a mannequin, and the adhesive agent 4 is applied onto the surface of the covering member 2.

Subsequently, the adhesive agent 4 is dried to an extent that the stickiness of the adhesive agent 4 is lost and causes no problem in the operation. Then, the covering member 2 is overturned, so that the applied adhesive agent 4 can be on an inner surface side. Then, by using the three-dimensionally formed clothing base member 1 as a core member, the covering member 2 is placed to entirely cover the surface 13. In other words, the covering member 2 is placed to entirely cover the clothing base member 1, with the applied adhesive agent 4 being in contact with the surface 13 of the clothing base member 1.

After that, a pressure is applied to the clothing base member 1 covered with the covering member 2, while the cross-linking of the adhesive agent 4 is being accelerated by heating in the same manner as in the second manufacturing method. Thus, a body protection product 10 can be manufactured in which the clothing base member 1 and the covering member 2 are attached to each other by using the adhesive agent 4. As described above, the adhesive agent 4 is applied on the surface (one surface side) 13 of the covering member 2 in advance. This eliminates the need for the operation for applying the adhesive agent 4 and the step of drying the adhesive agent 4, which would be otherwise conducted after formation of the clothing base member 1. Hence, the body protection product can be manufactured more efficiently by this method than by the above-described second manufacturing method.

Fourth Manufacturing Method

Moreover, the clothing base member 1 can also be formed by using a sheet-shaped fabric provided with an adhesive agent 4. Here, the sheet-shaped fabric is obtained by applying the adhesive agent 4 onto one surface of a sheet-shaped fabric excellent in stretchability and elasticity in advance.

Specifically, first, an adhesive agent 4 is applied onto one surface of a sheet-shaped fabric, and dried to an extent that the stickiness of the adhesive agent 4 is lost and does not cause any problem in the operation.

Subsequently, by using the sheet-shaped fabric on which the adhesive agent 4 has been applied in advance, multiple fabric pieces 11, . . . , 11 fitting a contour of a body shape of a wearer are prepared by cutting the sheet-shaped fabric using a draping technique.

Subsequently, cut surfaces 12 of the fabric pieces 11 are brought into contact with one another, with the one surface sides of the fabric pieces 11 on which the adhesive agent 4 has been applied facing the same direction. Then, the fabric pieces 11, 11 are joined to one another not by sewing but by using an adhesive agent 3. In this manner, an integrated three-dimensional clothing base member 1 is formed Moreover, by using the clothing base member 1 as a core member, the covering member 2 is placed to entirely cover the one surface 13 side on which the adhesive agent 4 has been applied.

After that, a pressure is applied to the clothing base member 1 covered with the covering member 2, while the cross-linking of the adhesive agent 4 is being accelerate by heating in the same manner as in the second manufacturing method. Thus, a body protection product 10 can be manufactured in which the clothing base member 1 and the covering member 2 are attached to each other by using the adhesive agent 4.

The sheet-shaped fabric provided with the adhesive agent 4 does not require the operation of applying the adhesive agent 4 or the step of drying the adhesive agent 4 after formation of the clothing base member 1. Hence, the body protection product can be manufactured more efficiently by this method than by the above-described second manufacturing method. Note, however, that the sheet-shaped fabric provided with the adhesive agent 4 is wasteful in a sense that if some excessive positions of the sheet-shaped fabric are discarded after being cut using a draping technique, some excessive positions of the adhesive agent 4 are also discarded accordingly. Hence, when the adhesive agent 4 is expensive, it is preferable to apply the adhesive agent 4 onto one surface side of the clothing base member 1 after formation of the clothing base member 1, as in the case of the second manufacturing method.

Fifth Manufacturing Method

In each of the first to fourth manufacturing methods, a liquid adhesive agent is used as the adhesive agent 4. However, the present invention is not limited to the liquid adhesive agent, but a film-shaped vulcanizable adhesive agent that joins adherends to each other by cross-linking upon heating can be used as the adhesive agent 4.

First, steps of forming a three-dimensional clothing base member 1 by using a sheet-shaped fabric excellent in stretchability and elasticity are the same as those in the first manufacturing method.

Subsequently, by using the clothing base member 1 as a core member, a covering member 2 made of a stretchable woven or knitted fabric formed to have a shape fitting the clothing base member 1 when stretched is placed to entirely cover the surface 13 of the clothing base member 1.

Moreover, the film-shaped adhesive agent 4 is disposed between the clothing base member 1 and the covering member 2.

After that, a pressure is applied to the clothing base member 1 covered with the covering member 2, while the cross-linking of the adhesive agent 4 is being accelerate by heating in the same manner as in the second manufacturing method. Thus, a body protection product 10 can be manufactured in which the clothing base member 1 and the covering member 2 are attached to each other by using the adhesive agent 4. In this manner, the clothing base member 1 and the covering member 2 are attached to each other by using the film-shaped adhesive agent 4. This eliminates the need for the operation of applying the adhesive agent 4 onto a surface of the clothing base member 1 or the covering member 2 and the step of drying the adhesive agent 4. Hence, the body protection product can be manufactured more efficiently by this method than by the above-described second, third, and fourth manufacturing methods.

As described above, in the body protection product 10 such as a wetsuit of the present invention, the fabric pieces 11,11 are not sewn together, but joined and integrated together by using the adhesive agents 3 and 4 and the covering member 2. In addition, in the wetsuit 10 according to this embodiment, the covering member 2 is placed to entirely cover the clothing base member 1, as if full-body tights were put on, and the clothing base member 1 and the covering member 2 are attached to each other and integrated with each other.

Accordingly, the body protection product 10 such as a wetsuit can be manufactured easily in a short period, without requiring any burdensome and time-consuming step such as a machine-sewing step. In addition, the body protection product 10 can be manufactured efficiently by selecting or modifying, as appropriate, any one of the above-described five manufacturing methods according to requirements such as the time, labor, and cost required for the manufacturing.

Figure 8:
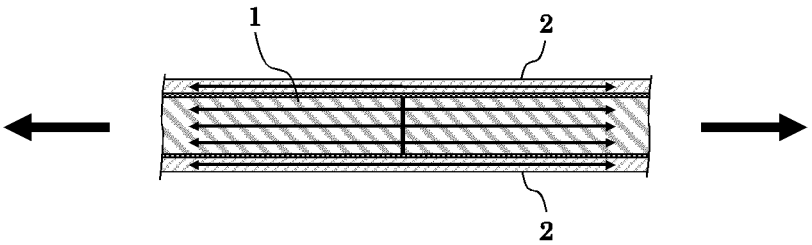
FIG. 8 is an enlarged partial schematic cross-sectional view illustrating stretching of the body protection product according to the present invention.

In addition, when the clothing base member 1 is stretched as shown by the arrows in FIG. 8, the covering members 2 are also stretched following the clothing base member 1, and the entirety is uniformly stretched. Hence, the joint portions between the fabric pieces 11 are not broken. In addition, when the wearer moves, every part is evenly stretched. Hence, the wearer does not feel uncomfortable due to inhibition of the stretching of the clothing base member 1.

Moreover, the surface does not three-dimensionally raised at the joint portions between the fabric pieces 11, and the surface state can be entirely smooth. Hence, when the body protection product 10 is worn, the joint portions in contact with the skin in putting on the body protection product 10 do not cause any discomfort. Moreover, the joint portions do not rub in a hooked manner during an action in an exercise or an operation, or do not inhibit the action.

Moreover, the surface of the clothing base member 1 is entirely covered with the covering member 2. Hence, the joint portions between the fabric pieces 11 are not exposed on the surface of the body protection product 10, and do not spoil the appearance. Hence, the body protection product 10 can be provided with a desired design by selecting, as appropriate, the color, pattern, and the like of the covering member 2, and can be further decorated without any decrease in the degree of freedom of design.

In addition, in the wetsuit 10 according to this embodiment, the clothing base member 1 and the covering member 2 can be stretched by approximately 5 to 7 times, and the neck insertion opening portion 20 can be extended to a size that allows the wetsuit 10 to be put on and taken off. The wetsuit 10 can be put on by extending the neck insertion opening portion 20, and inserting the legs into the neck insertion opening portion 20 followed by the hip, the chest, and the arms. Hence, as shown in FIG. 1, the wetsuit 10 according to this embodiment is not provided with any fastener which enables an area to be opened, as appropriate, for a wearer to put on and take off the wetsuit 10.

Note that, the wetsuit 10 shown in each of the drawings of the above-described embodiments is of a type from which the hands and the feet are exposed and for which gloves and boots are put on after the wetsuit 10 is put on. However, the wetsuit itself may be integrally provided with gloves and boots in advance.

In addition, in the invention, the shape of the clothing base member 1 can be designed, as appropriate, according to the purpose. In the above-described embodiments, cases where wetsuits are formed are described as examples; however, the present invention may be applied to a case where a drysuit is formed, and further may also be applied to a case where a boot, a glove, or a hood used with a wetsuit or a drysuit is formed.

INDUSTRIAL APPLICABILITY

The present invention is industrially useful in the category of business of body protection wears used for various water sports in or on the water such as diving, snorkeling, surfing, sailboarding, bodyboarding, water skiing, jet skiing, yachting, and fishing, lifesaving, camera shooting, harvesting of seaweed, shellfish, or the like, and other various operations in or on the water. The present invention is especially useful in the market of wetsuits and drysuits.

REFERENCE SIGNS LIST

H heater
1 clothing base member
2 covering member
3, 4 adhesive agent
10 body protection product (wetsuit)
11 fabric piece
12 cut surface
13 one surface
14 another surface
21 neck insertion hole

The invention claimed is:

1. A method for manufacturing a body protection product comprising:

a clothing base member comprising a torso, sleeves, a neck and pants legs, and three-dimensionally formed by a first plurality of fabric pieces in said torso, a second plurality of fabric pieces in each said sleeve and a third plurality of pieces in each said pants legs, with adjacent fabric pieces of said first, second and third plurality of fabric pieces being joined along facing cut surfaces with a first adhesive agent and not being sewn together; and a stretched covering member which entirely covers one surface side of the clothing base member and which is stretchable; wherein the clothing base member and the covering member are attached to each other with a second adhesive agent, and the covering member is seamless and integral and covers all the cut surfaces joined together by the first adhesive agent, with said one surface side of the clothing base member being entirely smooth, including the joined together cut surfaces, the method comprising:

adapting the first, second and third plurality of fabric pieces to fit a contour of a body shape of a wearer by cutting a sheet-shaped fabric possessing stretchability and elasticity;

applying the first adhesive agent onto the cut surfaces of the first, second, and third plurality of fabric pieces; then assembling the adjacent fabric pieces together with the cut surfaces being in contact with one another;

joining the adjacent fabric pieces together by compression bonding to form the clothing base member, with the adjacent fabric pieces not being sewn together; then entirely covering the one surface side of the clothing base member with the covering member by stretching the covering member over the clothing base member, the covering member made of a stretchable woven or knitted fabric, and (1) the covering member being smaller than the clothing base member in an unstretched state of the covering member, and (2) in a stretched state of the covering member, the covering member takes a shape of the clothing base member; and attaching the clothing base member and the covering member to each other by using the second adhesive agent.

2. The method for manufacturing a body protection product according to claim 1, wherein the second adhesive agent is a cross linkable adhesive agent that joins the clothing base member and the covering member to each other by cross-linking, and the clothing base member and the covering member are attached to each other by applying the second adhesive agent onto the one surface side of the clothing base member, then before the second adhesive agent has been dried, covering the clothing base member with the covering member, and cross-linking the second adhesive agent at room temperature.

3. The method for manufacturing a body protection product according to claim 1, wherein the second adhesive agent is a cross linkable adhesive agent that joins the clothing base member and the covering member to each other by cross-linking, and the clothing base member and the covering member are attached to each other by applying the second adhesive agent onto the one surface side of the clothing base member, reducing stickiness of the second adhesive agent by drying the second adhesive agent, then covering the clothing base member with the covering member, and further applying a pressure, while the cross-linking of the second adhesive agent is being accelerated by heating.

4. The method for manufacturing a body protection product according to claim 1, wherein the second adhesive agent is a cross linkable adhesive agent that joins the clothing base member and the covering member to each other by cross-linking, and the clothing base member and the covering member are attached to each other by applying the second adhesive agent onto an inner surface side of the covering member, reducing stickiness of the second adhesive agent by drying the second adhesive agent; then covering the clothing base member with the covering member, with the applied second adhesive agent located on the one surface side of the clothing base member and the inner surface side of the covering member; and further applying a pressure, while the cross-linking of the second adhesive agent is being accelerated by heating.

5. The method for manufacturing a body protection product according to claim 1, wherein the second adhesive agent is a cross linkable adhesive agent that joins the clothing base member and the covering member to each other by cross-linking, and the clothing base member and the covering member are attached to each other by applying the second adhesive to the one surface side of the clothing base member, covering, with the covering member, the clothing base member formed by using the sheet-shaped fabric on the one surface side of which the second adhesive agent has been applied, and further applying a pressure, while the cross-linking of the second adhesive agent is being accelerated by heating.

6. A method for manufacturing a body protection product, comprising:

adapting fabric pieces to form a torso, sleeves, a neck and pants legs, and fit a contour of a body shape of a wearer by cutting a sheet-shaped fabric possessing stretchability and elasticity into a first plurality of fabric pieces for said torso, a second plurality of fabric pieces for each said sleeve and a third plurality of pieces for each said pants legs;

applying a first adhesive agent onto cut surfaces of adjacent fabric pieces of each of said first, second and third plurality of pieces; then assembling the respective adjacent fabric pieces of each of said first, second and third plurality of pieces together with the cut surfaces being in contact with one another;

joining the respective adjacent fabric pieces together by compression bonding to form an integrated three-dimensional clothing base member, with the adjacent fabric pieces not being sewn together; then entirely covering a surface side of the integrated three-dimensional clothing base member with a covering member, by stretching the covering member over the integrated three-dimensional clothing base member, the covering member made of a stretchable woven or knitted fabric, and (1) the covering member being smaller than the integrated three-dimensional clothing base member in an unstretched state, and (2) in a stretched state of the covering member, the covering member takes a shape of the integrated three-dimensional clothing base member; and attaching the integrated three-dimensional clothing base member and the covering member to each other by using a second adhesive agent, wherein the second adhesive agent is a film-shaped cross linkable adhesive agent that joins the integrated three-dimensional clothing base member and the covering member to each other by cross-linking, and the integrated three-dimensional clothing base member and the covering member are attached to each other by covering the integrated three-dimensional clothing base member with the covering member, then placing the second adhesive agent between the integrated three-dimensional clothing base member and the covering member, and further applying a pressure, while the cross-linking of the second adhesive agent is being accelerated by heating.

* * * * *